United States Patent [19]

Jennings et al.

[11] 3,977,158

[45] Aug. 31, 1976

[54] WRAPPING MACHINE

[76] Inventors: Robert Jennings, 47, Monmouth Close, Nod Rise; Edward Henry Tew, 115, Kenilworth Court, Leamington Road, both of Coventry, England

[22] Filed: Sept. 13, 1973

[21] Appl. No.: 397,144

[52] U.S. Cl. ..... 53/226; 53/184 R

[51] Int. Cl.[2] ..... B65B 11/54

[58] Field of Search ..... 53/141, 184, 221, 226, 53/222, 228; 198/162, 165, 218; 271/191

[56] References Cited

UNITED STATES PATENTS

| | | | |
|---|---|---|---|
| 1,392,683 | 10/1921 | Hackett | 53/221 |
| 1,424,363 | 8/1922 | Leumann | 53/226 X |
| 2,301,106 | 11/1942 | Brown | 53/141 X |
| 2,554,636 | 5/1951 | Pfeiffer | 53/141 X |
| 2,757,499 | 8/1956 | Albrecht | 53/226 |
| 3,212,230 | 10/1965 | Coates | 53/228 |
| 3,662,513 | 5/1972 | Fabbri | 53/226 X |
| 3,683,586 | 8/1972 | Duckhinsky | 53/228 |

*Primary Examiner*—Travis S. McGehee
*Assistant Examiner*—John Sipos
*Attorney, Agent, or Firm*—Gifford, Chandler & Sheridan

[57] ABSTRACT

A wrapping machine wraps articles, such as vegetables and meat carried on trays, in sheets of stretchable film. A lifting platform lifts the articles into the film sheet at a wrapping station and wrapping blades engage each edge of the sheet to stretch the sheet and move the edges under the article. The wrapped article is pushed away from the wrapping station to a discharge conveyor where the film is heated to seal and secure the film around the article. The film sheets are fed in predetermined lengths to the wrapping station from a roll of film.

10 Claims, 19 Drawing Figures

WRAPPING MACHINE

BACKGROUND OF THE INVENTION

1. Field of the Invention

This invention relates to a wrapping machine for wrapping articles in stretchable sheet material, in particular stretchable plastics film material.

2. Description of the Prior Art

Suitable material for use in the wrapping machine is known as stretch film and is formed of thin plastics material capable of being secured in position after stretching by heating overlying layers of the material to weld the layers to one another.

It is known to effect stretch film wrapping of articles manually by locating an article on a tray, placing a sheet of film over the article, stretching the film over the article, and securing the film under the article by welding the overlying edges of the film under the article by the application of heat.

There has also been proposed a machine for automatically wrapping articles with stretch film but this has involved the use of a wrapping mechanism and discharge arrangement which has been found not to be satisfactory, particularly if a range of articles of different sizes and physical properties are to be wrapped.

An object of the invention is to provide a stretch film wrapping machine in which the wrapping of a wide range of articles can be effected, automatically and quickly.

SUMMARY OF THE PRESENT INVENTION

According to the invention a wrapping machine for wrapping articles in stretchable sheet material, comprises article feed means for feeding articles to a wrapping station, film feed means for feeding predetermined lengths of stretchable film to the wrapping station, a wrapping mechanism for wrapping said predetermined lengths of the film about the articles at the wrapping station and simultaneously stretching the film over the articles, and discharge means for discharging the wrapped articles from the wrapping mechanism and securing the film lengths around the articles, the feed means including a lifting table on which each article is lifted into a film length, and the wrapping mechanism including two pairs of wrapping blades, the blades of each pair moving in opposite directions to one another and transversely to the blades of the other pair and the blades being arranged to engage the film and move its edges under the article, the discharge means including a pusher which after operation of the wrapping blades discharges the wrapped article from the wrapping station.

Conveniently, the pusher is arranged to move reciprocally to engage the side of the wrapped articles to discharge the articles.

Preferably each of the wrapping blades is movable reciprocally, one pair of blades moving over the other pair of blades, and a blade of one of said pairs moving in the direction of discharge of the article during a wrapping movement of the blade.

BRIEF DESCRIPTION OF THE DRAWING

Further features of the invention appear from the following description of an embodiment of the invention given by way of example and with reference to the drawings, in which.

DETAILED DESCRIPTION OF THE PRESENT INVENTION

Figure 1:
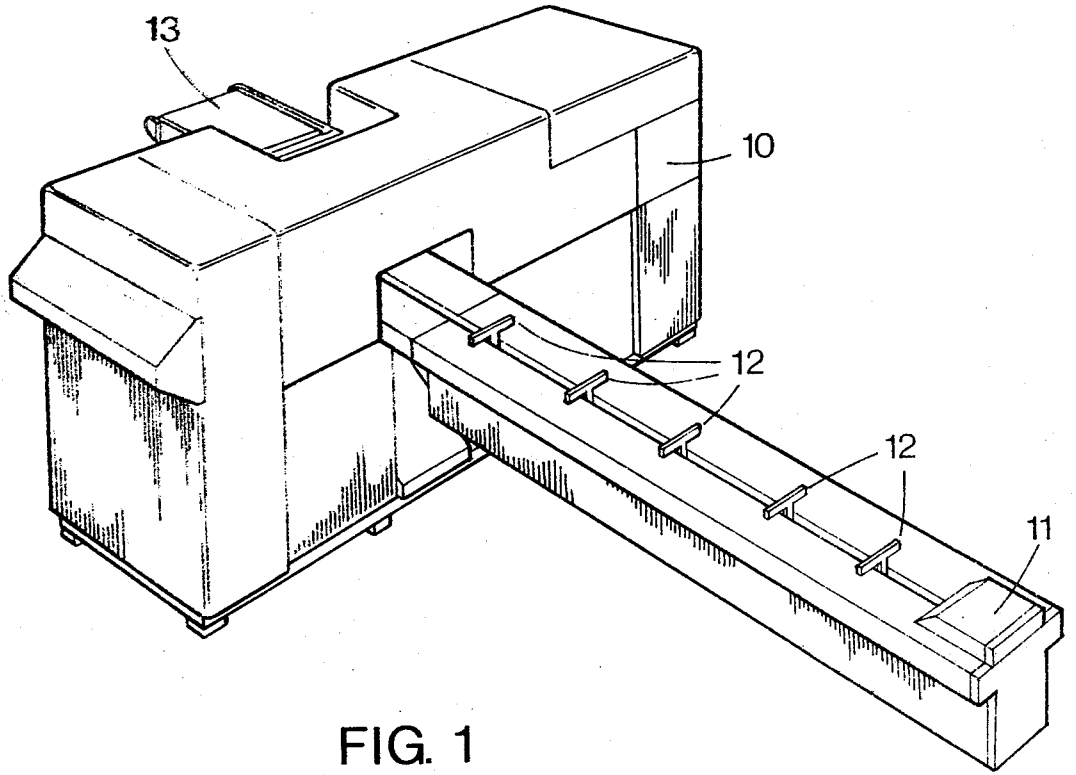
FIG. 1 is a perspective view of a wrapping machine according to the invention.
Figure 2:
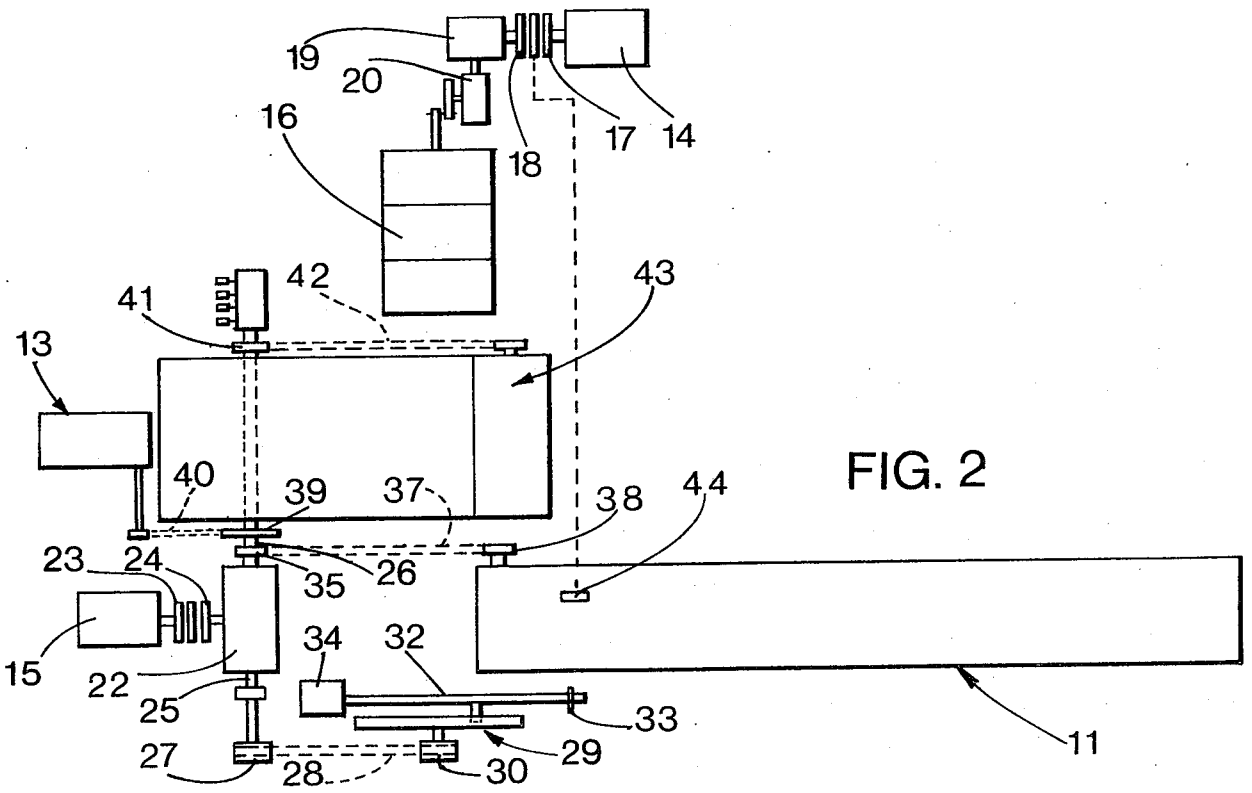
FIG. 2 is a diagrammatic plan view of the wrapping machine of FIG. 1 showing the drive arrangement.

Referring to the drawings and firstly to FIGS. 1 and 2 a wrapping machine is housed in a frame 10 and is arranged to wrap articles to be displayed in shops. A wide range of articles such as meat, vegetables and fruit can be wrapped by the machine and the machine is capable of wrapping articles having a wide range of sizes.

The articles are placed on a tray (not shown) of known form and the tray and articles are manually or otherwise placed on a feed conveyor 11 in the form of a chain conveyor having a plurality of bars 12 secured to the chain and equally spaced from one another, an article in the form of a tray usually being placed in front of each bar. The conveyor 11 carries the trays into the machine and a sheet of transparent film is located over the product on the tray and the edges are folded under the tray to be secured by applying heat to fuse the overlapped edges of the film. This latter sealing operation is carried out on a sealing conveyor 13 extending from the opposite side of the machine to the conveyor 11. The wrapping and sealing operations are described in detail later.

The film used in the wrapping operation is of the kind known as stretch film which is located over the tray and the product carried thereby and tension is applied to the film as the edges are drawn under the tray.

Referring now particularly to FIG. 2, the machine is provided with two drive motors, one 14 of which is for feeding the required amount of film for wrapping the articles, hereinafter referred to as the film feed motor, and the other 15 of which is for driving all the remaining powered mechanisms embodied in the machine and is hereinafter referred to as the main drive motor.

The various mechanisms driven by the motors 14 and 15 are only shown in simplified form and diagrammatically in FIG. 2 and further reference should be made to relevant Figures and description for a full understanding of the mechanisms.

The film feed motor 14 drives a film feed mechanism 16 through a transmission including a clutch 17, a brake 18, a speed reduction unit 19 and a crank unit 20, the crank unit 20 converting the rotary motion of the motor 14 into a reciprocating motion by which the feed mechanism 16 (more fully described in FIGS. 3–8) is driven. The action of the film feed mechanism is to draw out sheets of film of predetermined lengths from a roll of film (not shown).

The main drive motor 15 is operated continuously during normal operation of the machine and drives a speed reduction unit 22 through a clutch 23 and a brake 24. Drive shafts 25 and 26 extend from opposite ends of the unit 22 and the shaft 25 carries a pully 27 about which extends a drive belt 28 which transmits drive to a lifting arm drive mechanism 29 through a pulley 30. The mechanism 29 is described more fully with reference to FIGS. 10–15 and transmits a reciprocal pivoting movement to a lifting arm 32, having a pivotal mounting 33 at one end and carrying a lifting plate 34 at the opposite end. The lifting plate 34 is arranged to engage the underside of the trays to lift them into position for the wrapping operation.

The shaft 26 is a lay shaft which carries a pulley 35 around which extends a drive belt 37 transmitting drive to a drive shaft 38 of the feed conveyor 11. The shaft 26 also carries a pulley 39 for a drive belt 40 which drives a drive shaft of the discharge conveyor 13.

A further pulley 41 on the shaft 26 has a drive belt 42 which drives a wrapping mechanism 43 for wrapping the film around the articles. This mechanism 43 is more fully described with reference to FIGS. 9, 10 and 13–19.

The use of the main motor 15 for all the machine functions except the film feed mechanism ensures that all such functions are always in synchronism without the need for additional control units. The operation of the feed motor 14 independently of the other machine functions ensures that film is only fed as and when it is needed and this is achieved by having a detector 44, of any convenient kind such as a photo-electric cell, which actuates operation of the motor 14 when a tray is detected on the feed conveyor 11.

Figure 3:
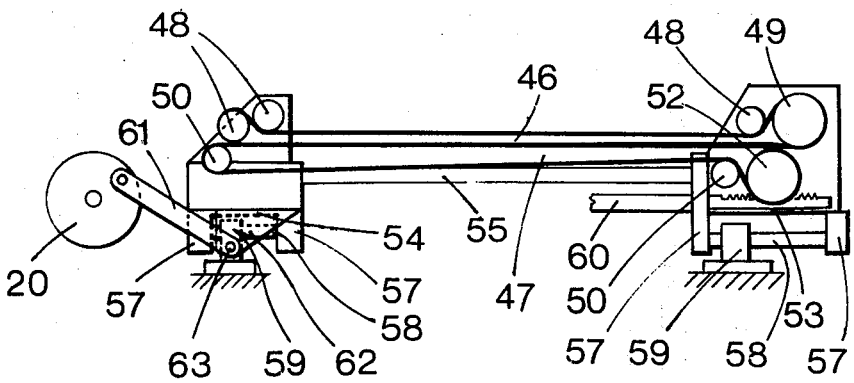
FIG. 3 is a side elevation showing a film feed belt arrangement and associated drive.
Figure 4:
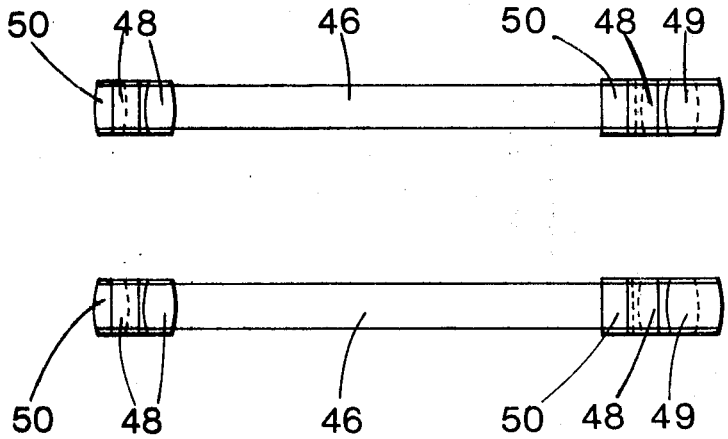
FIG. 4 is a plan view of the feed belt arrangement of FIG. 3.
Figure 5:
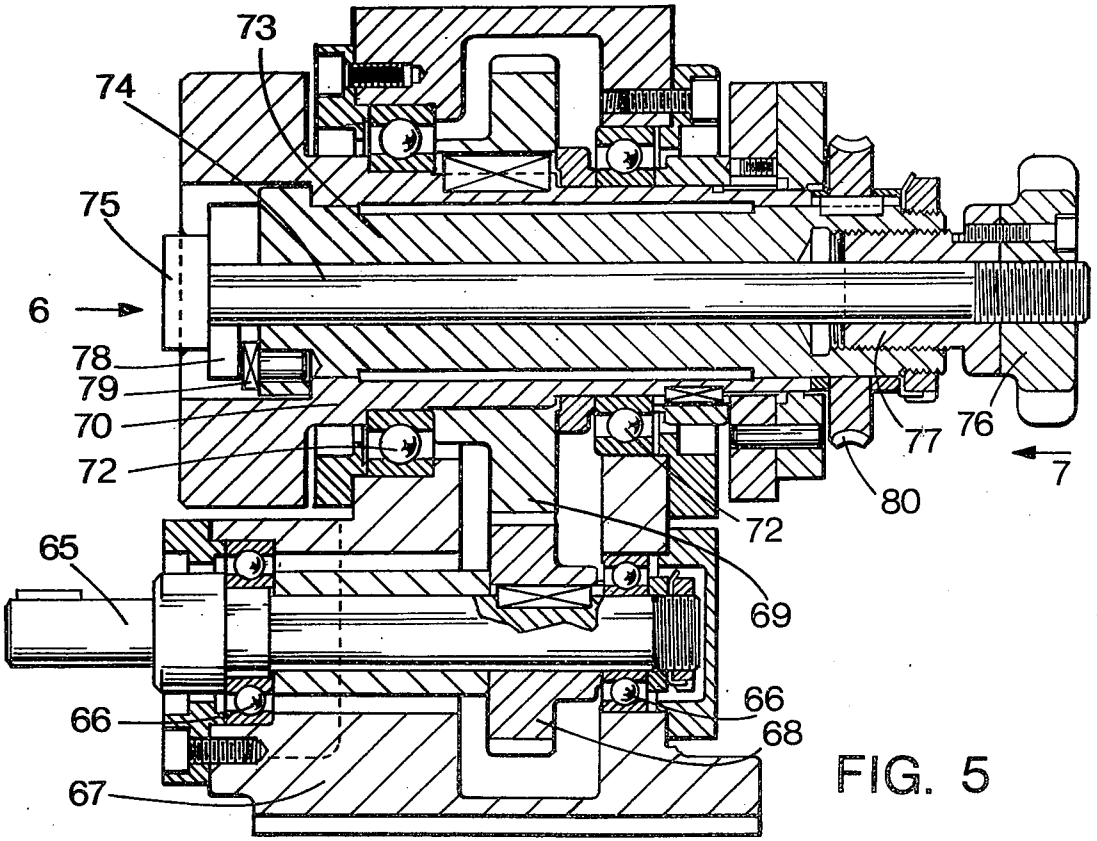
FIG. 5 is a sectional elevation of the film feed crank unit on the line 5—5 on FIG. 6.
Figure 6:
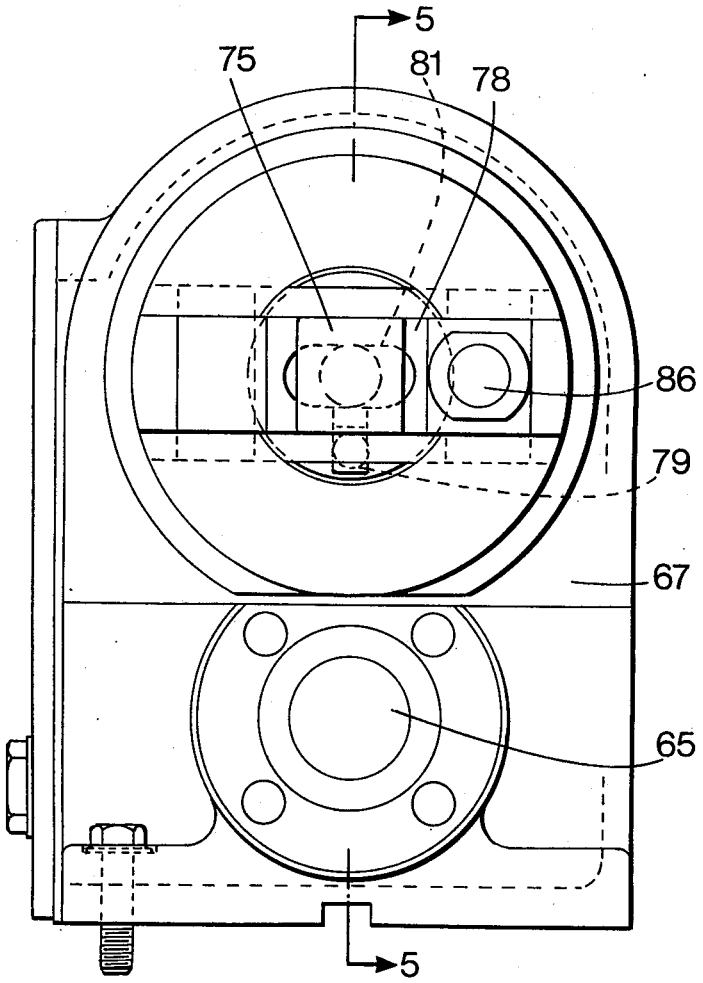
FIG. 6 is an end elevation in the direction of arrow 6 in FIG. 5.
Figure 7:
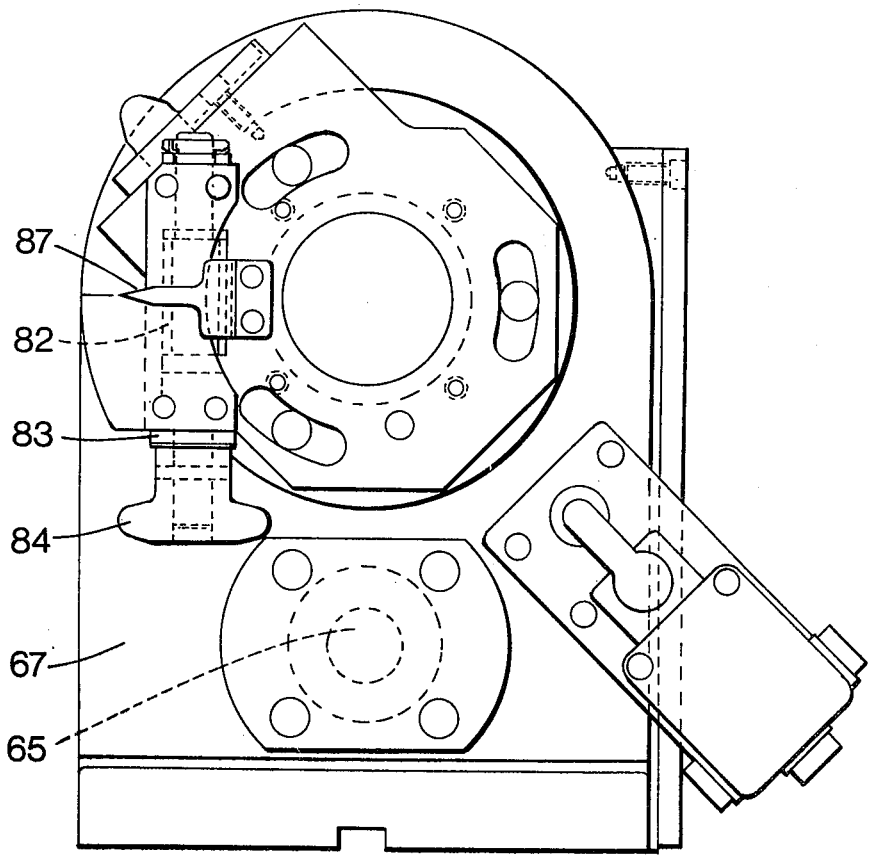
FIG. 7 is an end elevation in the direction of arrow 7 in FIG. 5.

There is now described the film feed mechanism 16 by which lengths of film are positioned for wrapping about the trays. Referring to FIGS. 3 and 4, the film is stored in the machine as a continuous length to be drawn off a roll (not shown) and cut up into individual sheets each of a length predetermined according to the size of the tray to be wrapped in the film. In passing from the roll the film is gripped between two pairs of belts an upper pair 46 and a lower pair 47. The upper pair of belts 46 each pass around sets of rollers, idler rollers 48 and a driving roller 49. Similarly the lower pair of belts 47 pass around idler rollers 50 and a driving roller 52. Each belt of the upper pair 46 is adjacent a belt of the lower pair 47 so that the conveying runs of the belts are closely adjacent to locate therebetween the film. Furthermore the belts of the upper and lower pairs are spaced longitudinally apart so that the belts engage the longitudinal edges of the film and the central portion of the film is free of the belts.

The driving rollers 49 and 52 are mounted in a frame 53 and the idler rollers 48 and 50 at the opposite ends of the belts are mounted in a frame 54. The frames 53 and 54 are interconnected by rods 55 to form a composite reciprocally movable unit each of the frames having lugs 57 between which extend guide and support bars 58 supported and guided in a support 59 fixed to the machine frame.

The frame 53 is associated with a fixed rack 60 with respect to which it is relatively movable and a gear wheel (not shown) on the frame 53 engages the rack 60 so that said relative movement rotates the gear wheel which is mounted on a shaft on which a driving roller 52 is also mounted. A gear wheel on the shaft on which a driving roller 49 is also mounted engages the gear wheel on the shaft for roller 52 and thus drive is transmitted to the rollers 49 and 52 so that they are rotated in opposite directions to drive the conveying runs of belts 46 and 47 in the same direction.

The frame 54 is connected to a crank arm 61 driven by the crank unit 20, the connection being effected through a bracket 62 extending downwardly from the frame and a pivot pin 63 carried on the bracket. Thus, depending on the throw of the crank, the frames 53 and 54 are moved simultaneously backwards and forwards a predetermined distance, the forward movement drawing film off the film roll and the rearward movement, i.e. to the left as seen in FIG. 3 repositioning the frames for a further forward movement. During a rearward movement a free wheel device (not shown) enables the driving roller 52 to free wheel and the belts 46 and 47 are held stationary relative to the machine frame at points on the conveying runs of the belts where they are engaging the film by means of clamps (not shown), the clamps enabling the film to be retained at the desired position for the tray to be subjected to a wrapping operation and the clamps being released prior to a further forward movement of the frames 53 and 54. The gearing to the rollers 49 and 52 serves to multiply the relative movement between the rack 60 and the gear wheel engaging the rack so that a length of film corresponding to but greater than the distance moved by the frames is drawn off the roll.

Referring now particularly to FIGS. 5–8 of the drawing, the crank unit 20 for transmitting drive from the reduction gearing unit 19 to the film feed mechanism 16 is arranged so that the throw of the crank can be infinitely varied between predetermined limits by simple adjustment means.

The unit 20 includes an input shaft 65 connected to the output shaft from the reduction unit 19 and carried in bearings 66 in a housing 67. A gear wheel 68 is keyed to the shaft 65 and meshes with a gear wheel 69 keyed to a hollow shaft 70 located in bearings 72. Within the shaft 70 is located a sleeve member 73 which member 73 is arranged for rotation with the shaft 70 and is movable axially relative to the shaft 70 to enable the throw of the crank to be adjusted, and the member 73 may be clamped to prevent said axial movement relative to the shaft 70 by clamping means. Such means includes a cylindrical rod 74 extending through an axial bore in the sleeve member 73 and formed with a disc member 75 at one end and a hand wheel 76 at the other end. The wheel 76 is connected to the rod 74 through a sleeve 77 which is in screw-threaded engagement with the sleeve member 73 so that rotation of the wheel 76 causes the member 73 to be moved in the axial direction relative to the rod 74 and to move the sleeve member 73 into and out of engagement with a crank block 78 having an elongate aperture 81 and being interposed between the member 75 and the sleeve member 73, and thereby clamps together the block 78 and the member 73. A pin 79 is secured to the end of the member 73 adjacent the block 78 and engages in an aperture in the block 78. A worm wheel 80 is carried on the member 73 for rotation therewith and the worm wheel 80 is in mesh with a drive worm 82 (FIG. 7) carried on a shaft 83 rotatable by a hand wheel 84. Thus if the hand wheel 76 is rotated to release the sleeve member 73 from a clamped condition and the hand wheel 84 is rotated the worm 82 drives the worm wheel 80 to rotate the sleeve member 73 relative to the block 78. This causes the pin 79 to engage the block 78 and move the latter radially of the axis of the rod 74 so that the rod 74 moves along the aperture 81, and a crank pin 86 carried by the block 78 and to which pin the crank rod 61 is secured, is moved a greater or lesser distance from the axis of the rod thereby adjusting the throw of the crank.

A pointer 87 associated with the worm 82 and worm wheel 80 moves over a scale in accordance with the displacement of the crank pin 86 from the axis to give an indication to the operator of the throw of the crank. The pointer 87 and associated scale are calibrated to give a direct indication of the length of film which will be fed by the film feed mechanism on each rotation of the crank. The crank adjustment means can be quickly and simply operated when a change in film length is called for by operation of the two hand wheels 76 and 84.

During the feeding of a length of film, cutting means (not shown) for perforating the lengths of film fed from the film roll is operated. The cutting means comprises a cutting plate located transversely of and over the film and having a plurality of downwardly directed points arranged to make a transverse row of perforations in the film. The cutting plate is mounted for pivoting about a horizontal axis transverse to the direction of movement of the film and, in the inoperative position of the plate, the plate is retained against pivoting by stops. When the cutting means is operated the plate is moved vertically downwardly to perforate the moving film and, as the plate moves downwards it is disengaged from the stops to enable it to pivot and thereby move with the film until retraction of the plate disengages it from the perforated film.

Actuation of the cutting plate is by a rack carried on the frame 54, the position of the rack being adjustable to allow for adjustment of the position at which the perforations are made according to the length of film required to be cut. Relative movement between the rack and the cutting plate causes the rack to move the plate vertically by way of transmission means.

The manner of cutting the film by first perforating the film along a line at which severance is to take place assists in the wrapping operation, as will be explained, because the wrapping mechanism, in severing the length of film, utilises the resistance of the perforations in the film to being parted to assist in stretching the film over the tray. It also overcomes problems in cutting this kind of film.

Referring to FIGS. 9, 10, 11 and 12 the lifting plate 34 for lifting trays delivered by the feed conveyor 11 from the delivered position to a wrapping station at which the trays are wrapped by the wrapping mechanism, is carried on the lifting arm 32 and is operated by the drive mechanism 29.

Figure 11:
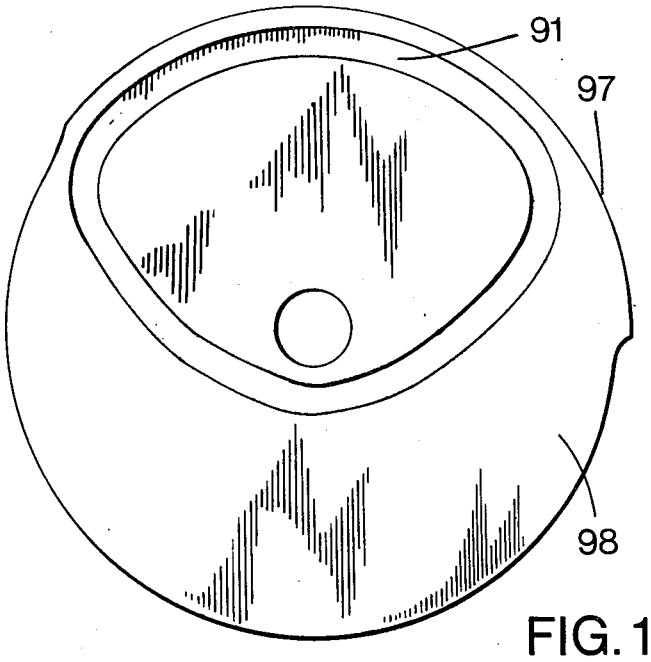
FIG. 11 is a view in the direction of arrow 11 in FIG. 9.

This lifting arm 32 is pivotally mounted on a pivot pin 33 for movement between an upper position and a lower position. The arm 32 carries a cam follower 90 which is located in a cam track 91 formed in a driven disc plate 98. The path of the cam track 91 over the face of the disc plate 98 is shown in FIG. 11 and the path is especially arranged to give the desired up and down motion and the dwell periods in the up position and in the down position of the lifting plate carried on the arm 32.

The end of the arm 32 remote from the pivot pin 33 is fitted with a rotatable roller 92 located between guide plates 93 mounted on a carriage 94 which is movable reciprocally vertically on a fixed cylindrical guide rod 95 secured to the machine frame. A cantilever arm 96 is secured to the upper end of the carriage 94 and supports at its upper end the lifting plate 34 (FIG. 12).

The disc plate 98 is keyed to a shaft 200 which is driven from the output shaft from the main drive motor 15. The shaft 200 also drives the wrapping mechanism 43, as will be described later. The external periphery of the disc plate 98 is formed with a cam surface 97 as seen in FIG. 11 and this surface is engaged by a follower (not shown) by which a clamping bar operable during the wrapping operation to clamp the film is actuated. Further reference to the clamping bar is made in the description of the wrapping mechanism.

Figure 12:
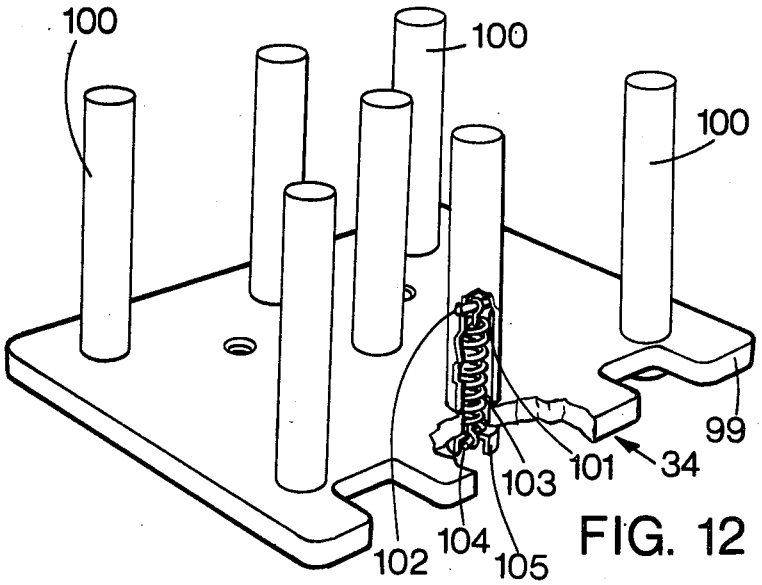
FIG. 12 is a perspective view of a lifting platform.

Referring now to FIG. 12 the lifting platform 34 is in the form of a rectangular plate 99 carried on the arm 96, and on the upper surface of the plate are identical support members 100. Each of the support members is a cylindrical rod having an axial bore 101 formed in its lower end and each rod is located over a hole through the plate 99. A pin 102 secures the upper end of a spring 103 in the bore 101 of each rod and the lower end of the spring 103 extends through the hole in the plate 99 and is secured on the underside of the plate 99 by a further pin 104 carried by a cup-shaped securing member 105. The base of each rod 100 is flush with the upper surface of the plate 99 in their upright position so the rods are biased towards the position shown in FIG. 12, i.e. extending vertically from the upper surface of the plate 99. However each rod can be tilted from the vertical against the action of the spring 103 upon a force transverse to the longitudinal axis of the rod being exerted on the rod. In the fully supporting positions of the lifting platform an article rests on the flat upper ends of the rods. During the wrapping operation the weight of the article is transferred from the rods to the wrapping blades as the rods are tilted from their supporting positions by the wrapping blades, as will be described.

Figure 13:
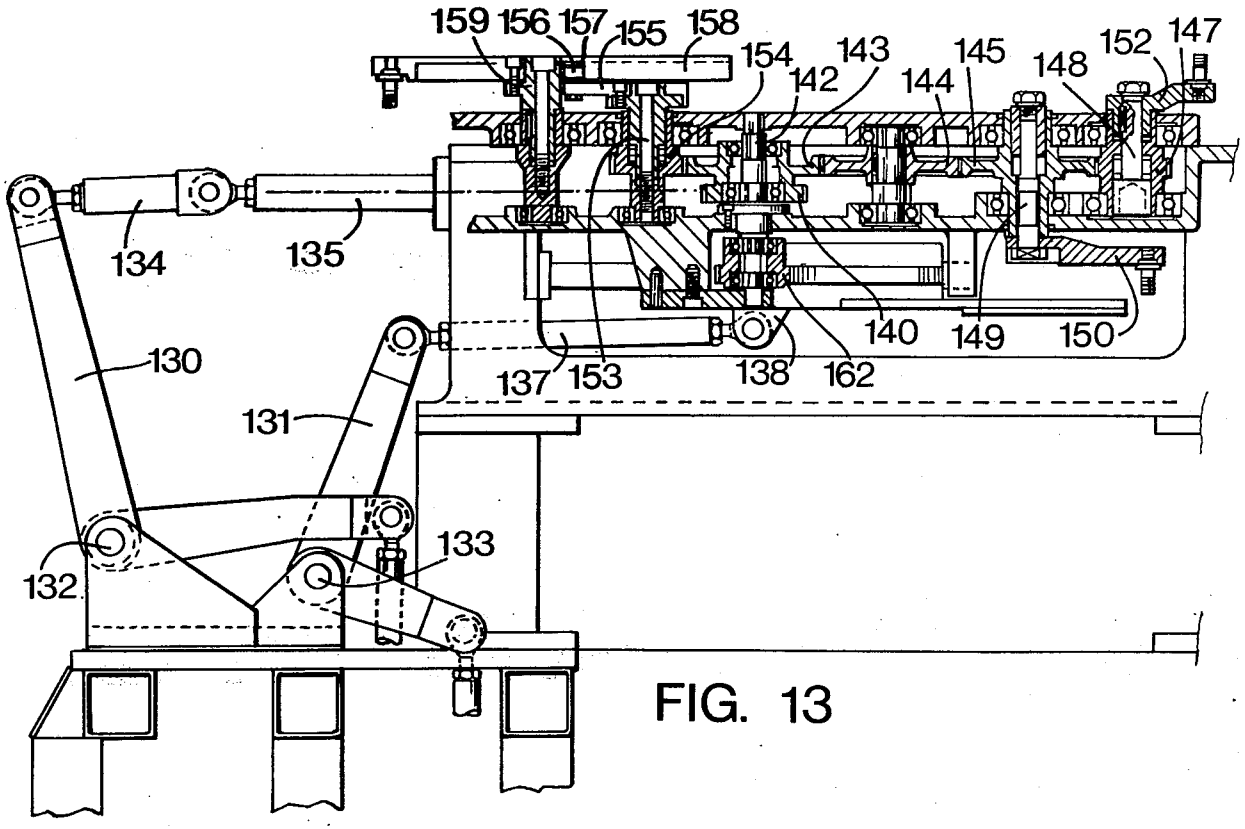
FIG. 13 is a side elevation showing part of the wrapping mechanism and a section through part of the transmission to said mechanism.

Reference is now made to FIGS. 9, 10, 13–19 in which is shown the wrapping mechanism 43. As described with reference to FIG. 2 drive to the mechanism is from the main motor 15 and the drive is taken to the shaft 200 (FIG. 9) and to a cam disc 201 keyed to the shaft on which disc are formed endless cam tracks 202 and 203 on opposite faces of the disc 201, the grooves being of generally circular or elliptical form (FIG. 10) and each being arranged to locate a cam follower 204 and 205. As the disc 201 is rotated the cam followers 204 and 205 are moved in a manner predetermined by the form of the grooves and the followers are located on links 206 and 207 supported about a pivot 208 and connected to the lower ends of links 210 and 209 extending upwardly for connection to actuating arms 130 and 131 (FIG. 13).

The arms 130 and 131 are each connected through a link to one of the follwers and the arms 130 and 131 are pivotally carried on pivots 132 and 133 respectively, mounted on the machine frame. The configuration of the tracks 202 and 203 and hence the movement of the followers 204 and 205 are different from one another and are selected according to the desired movement of the wrapping blades associated with each follower. Thus the arm 130 is connected to move two wrapping blades, hereinafter referred to as the front and rear blades, and a pusher, and the arm 131 is connected to move two wrapping blades, hereinafter referred to as the side blades.

Figure 14:
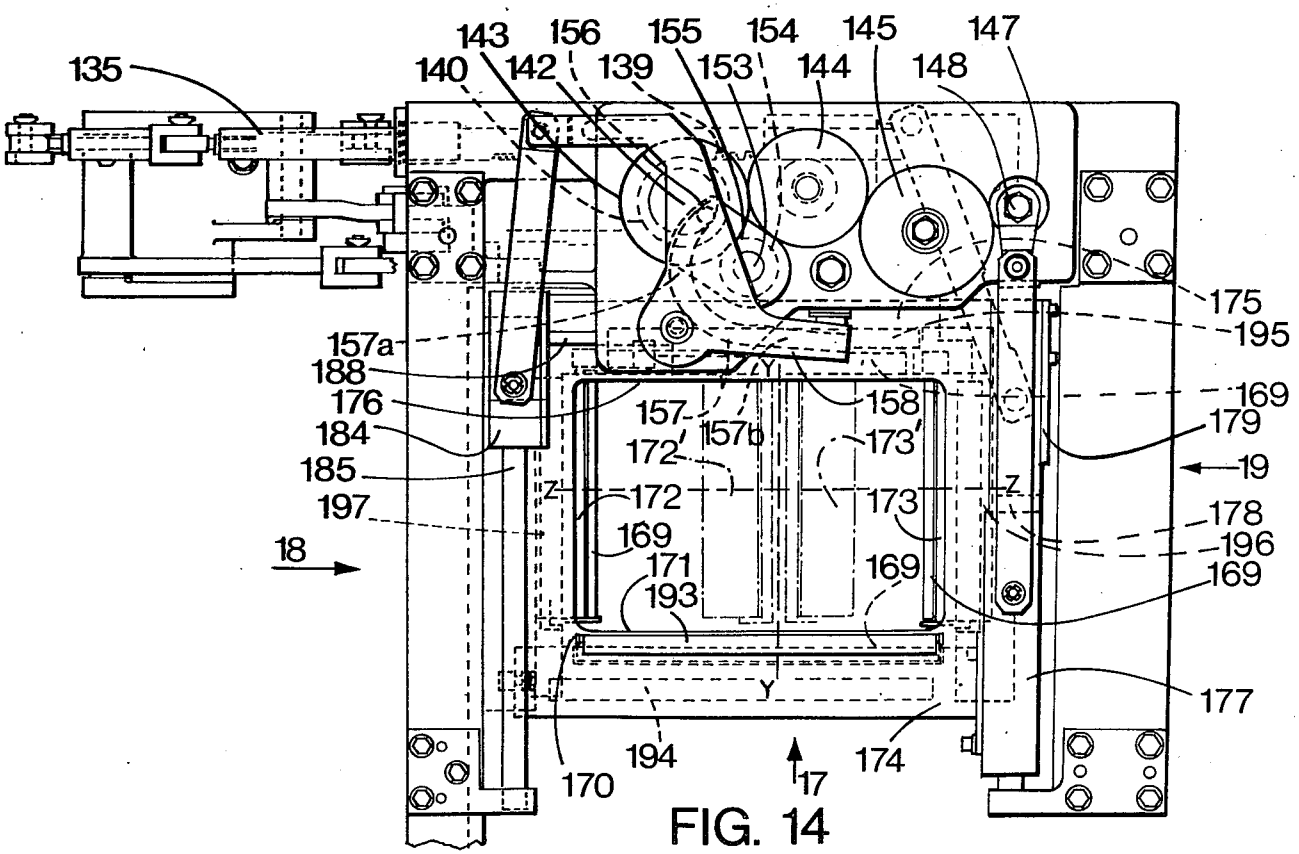
FIG. 14 is a plan view of the transmission to the wrapping blades and of the wrapping blades.

At its upper end the arm 130 is pivotally attached to a link 134 which in turn is attached to a rack member 135 incorporated in a transmission shown in FIGS. 13 and 14. The upper end of the arm 131 is connected through a rod 137 to a carrier 138.

Referring now to FIGS. 13 and 14 the rack member 135 is subjected to a reciprocating motion by the arm 130 and the member 135 is formed with teeth 139 which mesh with teeth formed on a gear wheel 140 having 48 teeth carried on a shaft 142. The angular movement of the shaft 142 resulting form movement of the actuating arm 130 is 180° in the forwards and reverse direction. Drive is transmitted from the gear wheel 140 to a gear wheel 143 having 64 teeth and also carried on the shaft 142, and then through a gear wheel 144 to a gear wheel 145, each of the latter two gear wheels also having 64 teeth. Drive is transmitted from the gear wheel 145 to a gear wheel 147 carried on a shaft 148 and having 32 teeth.

The gear wheel 145 is carried on a shaft 149, and the shaft 149 and the shaft 148 carry actuating arms 150 and 152 respectively. The driving ratio between the shaft 142 and the shaft 149 is one to one; thus the movement of the arm 150 is through 180°. On the other hand the driving ratio between the shaft 142 and the shaft 148 is two to one and the movement of the arm 152 is through 360°.

Drive is also transmitted from the shaft 142 to a shaft 153 through the gear wheel 143 and a gear wheel 154 having 32 teeth. Thus the drive ratio between shaft 142 and 153 is two to one and the shaft 153 reciprocates through 360°. Shaft 153 carries an arm 155 on the end of which is a cam follwer 156 which engages a track 157 in an arm 158. The track 157 is, over one portion 157*a*, of arcuate shape having an arc of 90° and over the remaining portion 157*b* is straight. Thus, as the follower 156 moves along the track 157, no movement of the arm 158 takes place as the follower 156 moves through 90° along the portion 157*a*. As the arm 155 moves through the next 270° of movement the follower moves along the portion 157*b* of the track and the arm 158 is rotated about a shaft 159 through 90°. Thus for 360° of movement of the shaft 153, the shaft 159 is turned through 90°. The mechanism, including the cam track 157 and follower 156, is termed an inverse geneva mechanism.

The connecting rod 137 is connected to the carrier 138 and the carrier 138 (FIGS. 15 and 16) is given a reciprocal movement thereby. The carrier 138 carries a rack 160 which is engaged by a free running pinion 162 located on the shaft 142 and the pinion 162 also engages a rack 163 carried on a carrier 164. Thus, as the carrier 138 is moved in one direction the carrier 164 is moved in the opposite direction. The carriers 138 and 164 are supported for movement along shafts 165 and 166 respectively.

Referring now particularly to FIGS. 14, 17–19 FIG. 14 shows a plan view of wrapping blades and associated structure. A plate 170 defines an opening 171 up through which trays containing a product to be packed are inserted supported on the lifting platform, the stretch film extending under the plate 170 and across the opening 171 so that the edges of the film lie below the edges of the tray prior to the wrapping operation. Two sets of wrapping blades are arranged to engage the film and draw the edges under the tray and then the wrapped tray is discharged from the wrapping position to be conveyed to sealing means where the film is sealed under the tray.

Figure 17:
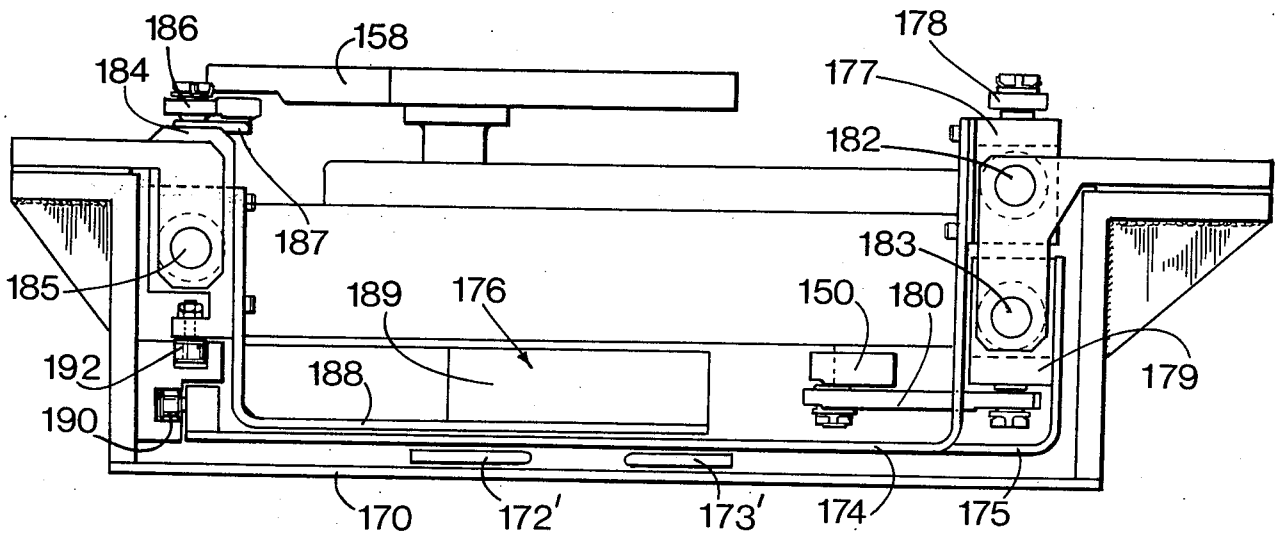
FIG. 17 is a view in the direction of the arrow 17 in FIG. 14.
Figure 18:
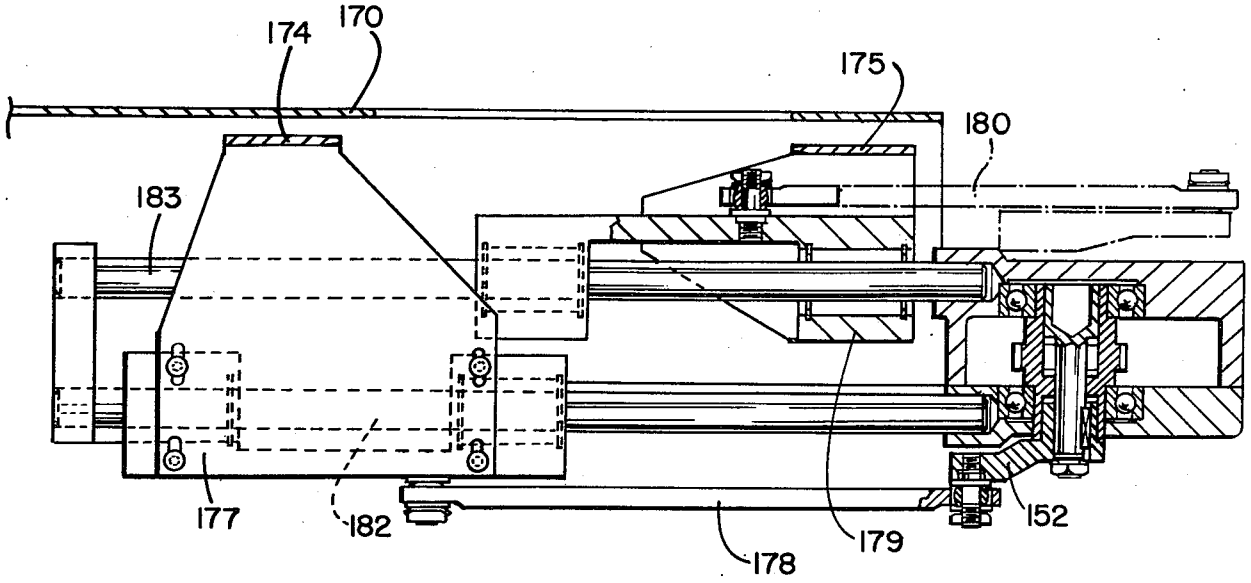
FIG. 18 is a view in the direction of arrow 18 in FIG. 14 and, FIG. 19 is a view in the direction of arrow 19 in FIG. 14.
Figure 19:
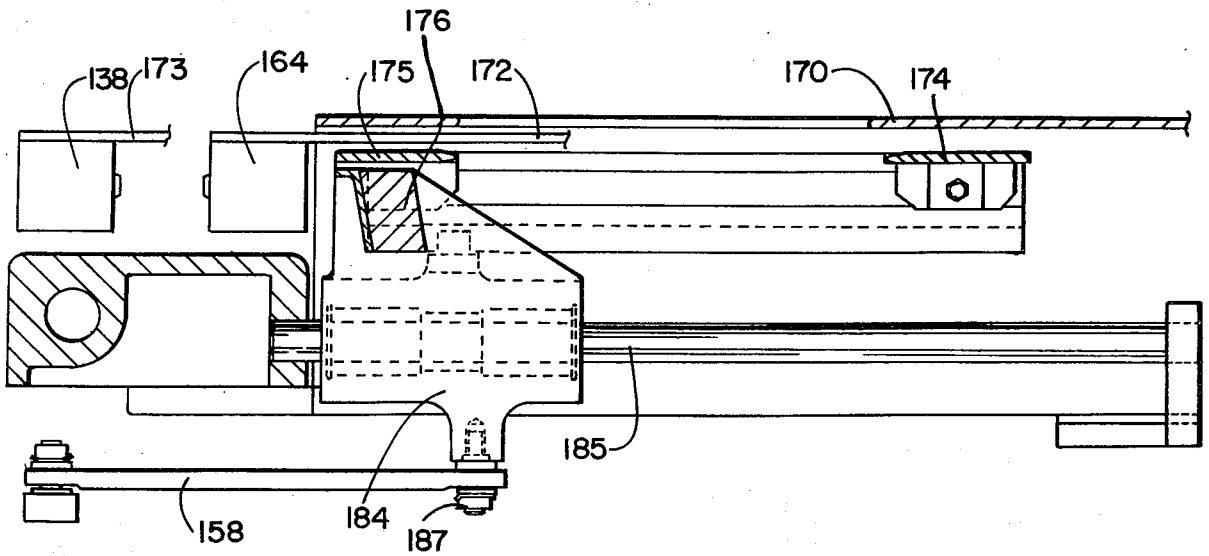

The two sets of blades comprise side blades 172 and 173, and front and rear blades 174 and 175 respectively. The side blades 172 and 173 are arranged to be moved toward one another to arrive at the position shown at 172' and 173' in FIGS. 14 and 17 at the end of a wrapping movement and then to move apart clear of the opening 171. The front and rear blades 174 and 175 are also arranged to be moved from an initial position clear of the opening 171, as shown in FIGS. 14 and 17 towards one another to engage the film and wrap the film under the trays.

Each of the blades 172, 173, 174 and 175 is fitted with a roller 169 at its leading edge, i.e. the edge that engages the film, so that during the wrapping operation the film readily moves over the roller and does not adhere to or wear the blades.

A pusher 176 is also provided and the pusher is arranged to engage the side of the tray after the wrapping blades have wrapped the film around the tray to discharge the wrapped tray from the wrapping position.

The front blade 174 is mounted on a carrier 177 to which is attached a link 178 secured to the arm 152. Thus movement of the arm 152 actuates the front blade 174. Similarly the rear blade 175 is mounted on a carrier 179 to which is attached a link 180 secured to the arm 150 and the rear blade 175 is actuated by the arm 150. The carriers 177 and 179 are mounted on horizontal guide bars 182 and 183 respectively which are mounted on the machine frame.

Figures 8, 15:
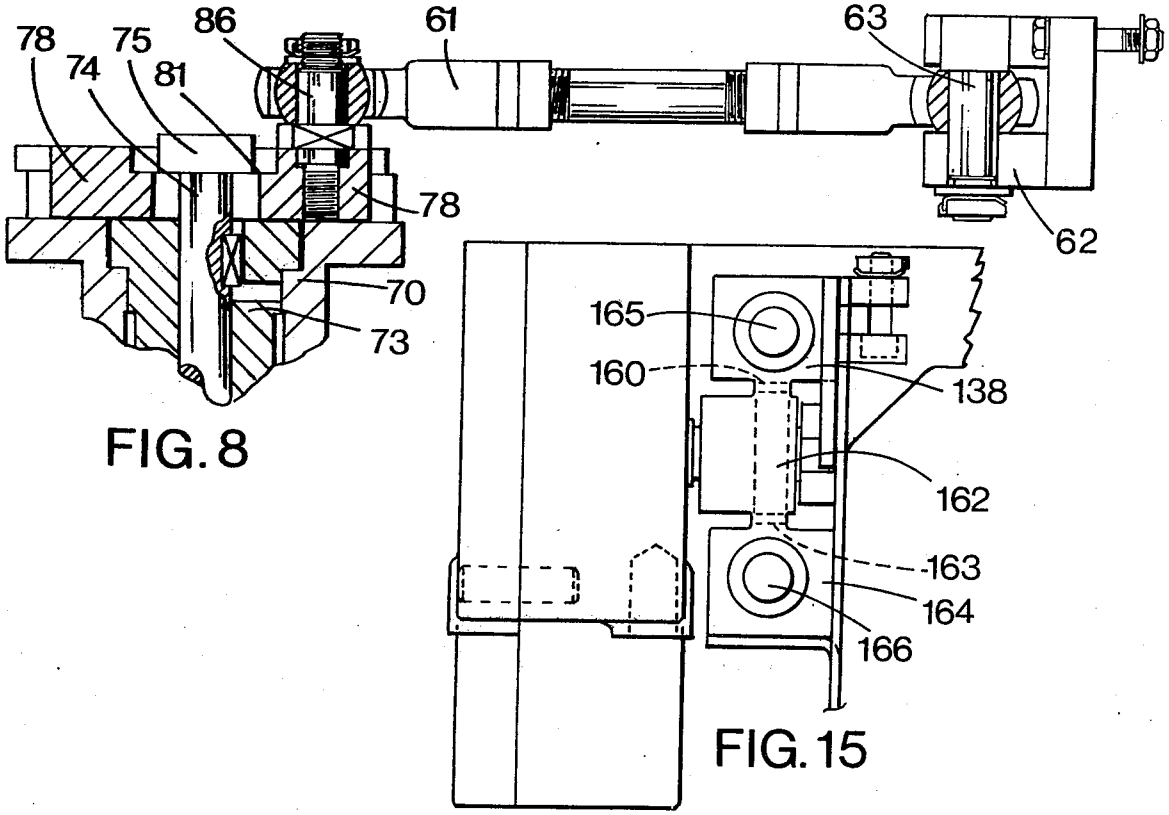
FIG. 8 is a plan view of the crank arm.
FIG. 15 is an end view of part of the transmission.
Figure 9:
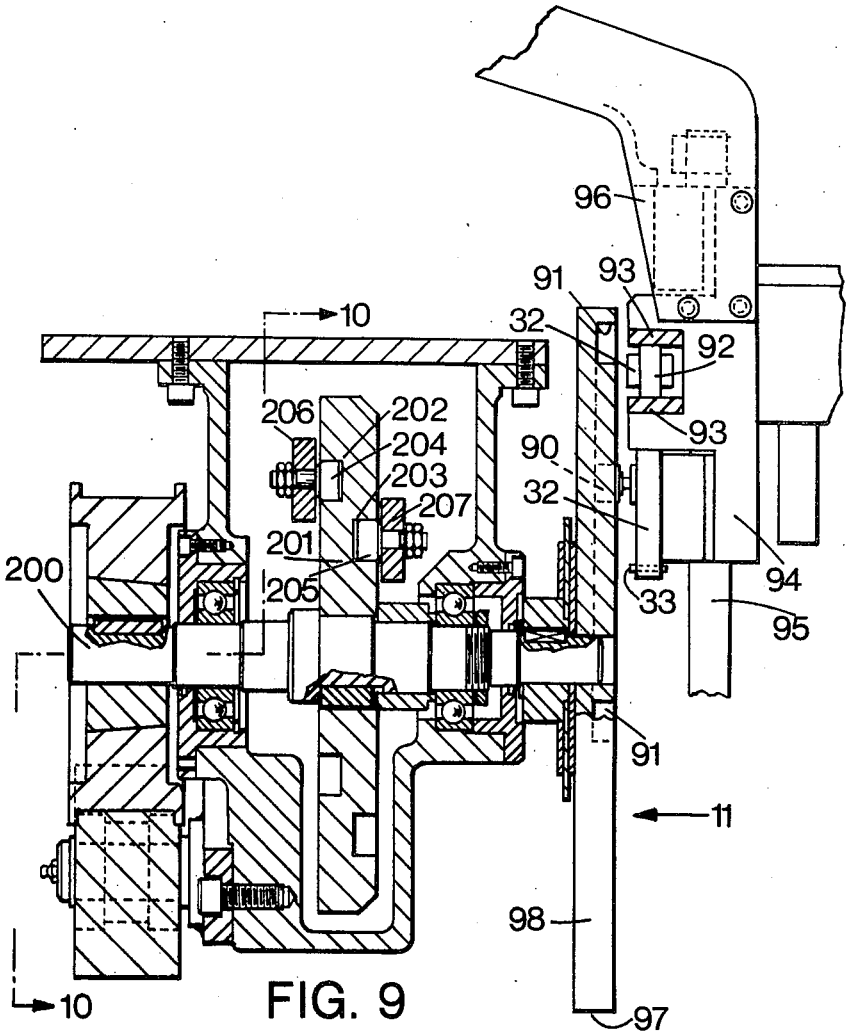
FIG. 9 is a side elevation of the drive to the lifting platform and the wrapping blades.
Figure 10:
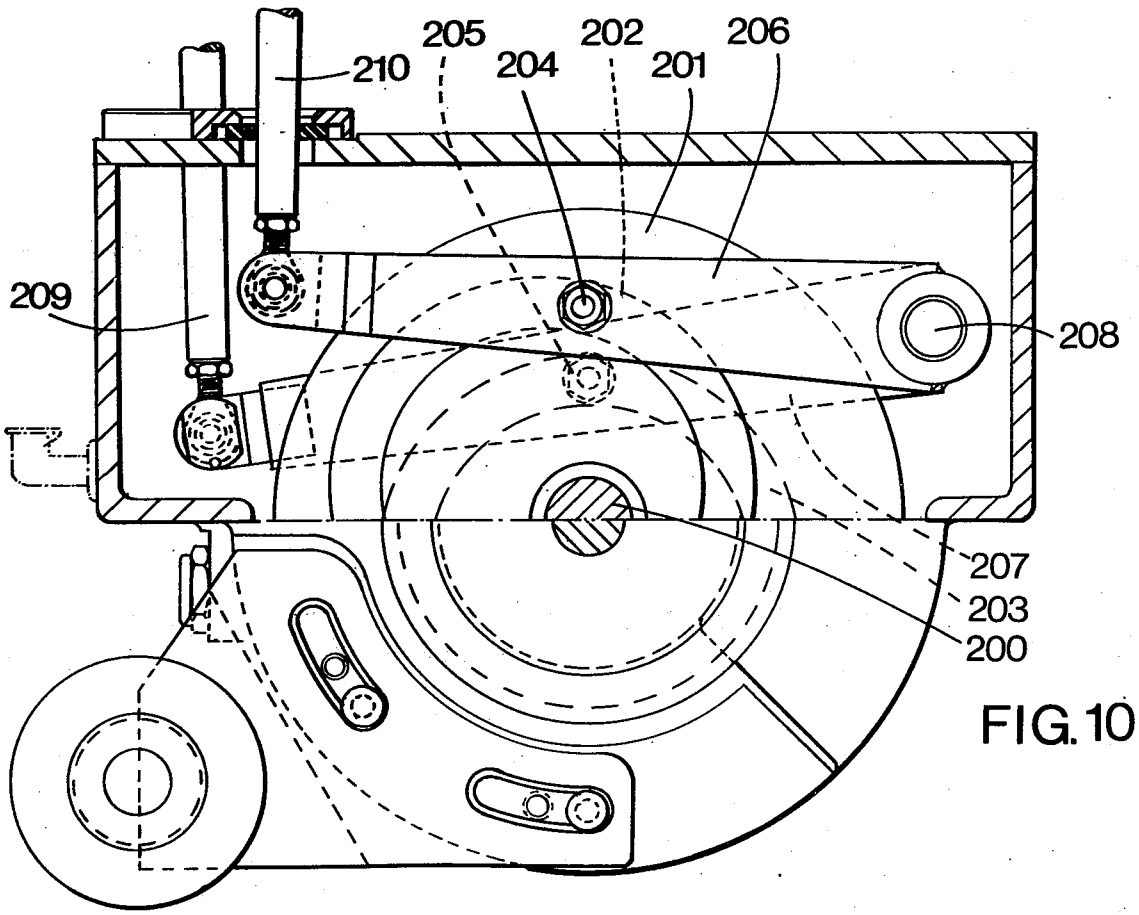
FIG. 10 is a section on the line 10—10 in FIG. 9.
Figure 16:
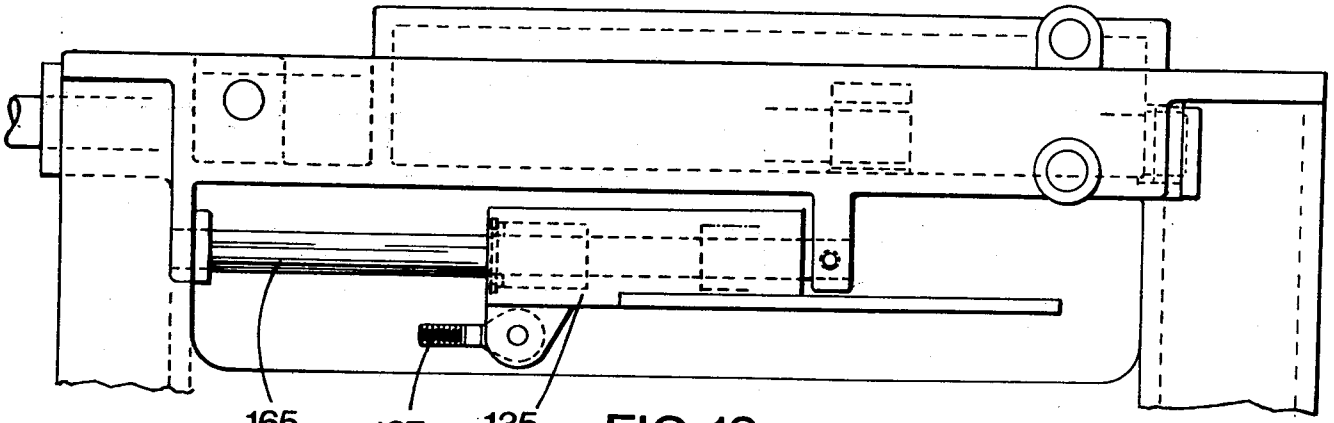
FIG. 16 is a plan view of the wrapping mechanism.

The side blades 172 and 173 are mounted on the carriers 138 and 164 as described with reference to FIGS. 15 and 16 and the side blades are located under the front and rear blades.

The pusher 176 is mounted on a carrier 184 which is guided on a guide bar 185, and a link 186 connects the carrier 184 to the arm 158 through a pivotal connection 187. The pusher 176 is in the form of a rectangular plate which is connected to the carrier 184 by an L-shaped plate 188 and the pusher plate 176 is fitted with a rubber pad 189 which engages the trays during a pushing action.

The front and rear blades 174 and 175 are supported on their ends remote from their associated carriers by rollers 190, FIG. 17 (only that for the front blade being shown). Similarly the pusher 176 includes a roller guide 192.

The wrapping mechanism also includes a stop plate 193 located at the discharge side of the plate 170 and supported thereby. The stop plate 193 is pivotally mounted to pivot from a position in which its flat surface lies parallel to and adjacent the plate 170 to a position in which it extends upwardly from the plate 170. In the latter position the stop plate 193 constrains an article in the wrapping position from moving towards the discharge direction. However when the article has been wrapped, the plate 193 is pivoted away from the upright position to allow discharge to take place. Actuation of the pivoting movement of the stop plate is effected by a cam and follower arrangement (not shown) operated by relative movement between the side blade 173 and structure supporting the plate 170.

The wrapping mechanism is also fitted with a set of clamping devices for ensuring that the edges of the film are held sufficiently during the wrapping operation that the film is stretched over the article.

Four such clamping devices are provided, a pair being associated with the front and rear edges of the film to resist the action of the front and rear blades 174 and 175 in drawing such edges under the article. One device 194 of the pair lies adjacent the front blade 174 and is a clamping bar arranged to be spring-urged against the underside of the belt 47, between which belt 47 and the belt 46 the film is located. Similarly the other device 195 of the pair is a clamping bar spring-urged against the underside of the pair of belts 46 and 47 between which the other opposite edge of the film is located. The clamping bars 194 and 195 serve to increase the grip of the belts 46 and 47 on the film which gives the desired resistance and resultant stretching of the film and also gives additional grip to e enable the film to be drawn off the film roll by the belts. Each of the clamping bars 194 and 195 pushes the belts 46 and 47 up against the underside of the plate 170 to thereby increase the clamping effect.

The two other clamping devices are for the side edges of the film. One of these devices is in the form of a clamping bar 196 lying adjacent the side blade 173. The bar 196 is arranged to be operated to bear against the underside of the plate 170 with the edge of the film clamped between the bar 196 and the plate 170. This action is performed at the beginning of the wrapping operation and the bar 196 is released from its clamping position after the side blade 173 has stretched the film. As previously mentioned, the disc plate 98 actuates the clamping bar 196 through its cam surface 97 and a cam follower and linkages (not shown) connected to the bar 196.

The other clamping device for the other side edge is similar to the clamping bar 196 in that it is a clamping bar 197 which engages the underside of the plate 170, thereby clamping the film. However in this case the bar 197 is operated by an electric solenoid (not shown) in synchronism with the wrapping operation and the bar 197 is held in the clamping position until the wrapping operation is completed. This is because the film length to be used for the wrapping operation has not, at the start of the operation, been severed from the film roll but has only been perforated. The operation of the side blade 172 severs the film because the bar 197 clamps the film beyond the perforations. Thus as the film is drawn under the article by the blade 172, it stretches the film until the tension becomes too great and the film parts along the perforations.

Operation of the wrapping blades is as follows. Reference to the drive arrangement, described with reference to FIGS. 14–19, will enable an understanding of the movement of the arms 150 and 152 moving the front and rear blades, the carriers 138 and 164 moving the side blades 172 and 173, and the arm 158 moving the pusher 176, to be obtained. In terms of the blade and pusher movements the actuating means give the following movements to these parts. The front and rear blades at the start of an operating cycle move towards the transverse centre line of the opening 171 as indicated by Z—Z in FIG. 14. The rear blade 175 passes across the centre line Z—Z and as it does so the movement of the front blade 174 is reversed so that the blades then move in the same direction. By the time the rear blade 175 has approached close to the centre line Z—Z the lifting plate 34, on which the tray has been supported up to this time, is withdrawn downwardly, the tray now being supported on the blades 174 and 175.

The pusher 176 remains stationary over the initial part of the cycle and does not start to move until after the front and rear blades have completed their movement and the stop plate 193 has been lowered. Movement of the pusher then commences and the pusher catches up with the rear blade 175, after this blade has moved over the centre line Z—Z, and engages the tray to discharge it from the wrapping position.

At the same time as the front and rear blades are beginning their initial movement the side blades 172 and 173 are moved towards the longitudinal centre line Y—Y of the opening 171. As the side blades move forward they contact the support members 100 of the lifting plate 34 which members are thereby tilted leaving the tray supported on the centre support 99 and the front and rear blades 174 and 175.

As each of the four blades move towards their respective centre lines Z—Z, Y—Y they engage the film and urge it under the tray. A resistance to such movement of the film is provided by the clamping devices 194, 195, 196 and 197 which engage the longitudinal edges of the film and the transverse edges of the film as described.

On discharge of the tray with the length of film stretched over the top with the edges overlying one another underneath, the tray passes over rollers (not shown) at the discharge side of the plate 171, under the action of the pusher 176, and onto a discharge and sealing conveyor (not shown). The base of the tray with the overlying film is in contact with the conveyor which is in the form of a conveyor belt with a heating element underneath. The heat from the element causes the film layers to fuse to one another to hold the film in position.

After discharge of the tray the blades and the pusher return to their initial positions to await a further tray to be subjected to the wrapping procedure and the cycle of operations is repeated.

The machine described is capable of wrapping a tray in about 2 seconds giving an overall throughput of about 30–40 trays a minute.

What we claim as our invention and desire to secure by Letters Patent of the United States is:

1. A wrapping machine for wrapping articles in stretchable sheet material, comprising article feed means for feeding articles to a wrapping station, film feed means for feeding predetermined lengths of stretchable film to a wrapping station, holding means for holding the edges of the lengths of film at the wrapping station, a wrapping mechanism for wrapping said predetermined lengths of the film about the articles at the wrapping station, and discharge means for discharging the wrapped articles from the wrapping mechanism and securing the film lengths around the articles; the film feed means including two pairs of conveyor belts movable over guide and drive rollers carried on a frame movable in a feed and return movement by adjustable drive means, the belts being arranged at the sides of the lengths of film, one pair at each side, and the film being located between the belts of each pair, the holding means being urged against each pair of belts towards a fixed abutment so that the belts firmly engage the edges of the lengths of film and thereby resist the withdrawal of the film from the belts during the initial part of the wrapping operation, the drive means including a rack operatively connected to the drive roller so that upon relative movement between the frame and the rack in a drive movement the drive roller rotates to move the conveyor belts to feed the film to the wrapping station; the article feed means including a lifting platform on which each article is lifted into a film length; and the wrapping mechanism including two pairs of wrapping blades, the blades of each pair moving in opposite directions simultaneously to one another and transversely to the blades of the other pair and the blades each being arranged to engage the film and move its edges under the article while the article is at the wrapping station, the holding means holding the edges of the film during the initial part of the wrapping operation of the blades to thereby stretch the film, the discharge means being actuated after operation of the wrapping blades to discharge the wrapped article from the wrapping station.

2. A wrapping machine according to claim 1 wherein each of the wrapping blades is movable reciprocally, one pair of blades moving over the other pair of blades, and a blade of one of said pairs moving in the direction of discharge of the article during a wrapping movement of the blade.

3. A wrapping machine according to claim 1 wherein the lifting platform is reciprocally vertically movable to raise each article upwardly into engagement with a length of film, the lifting platform being operable to move articles to the wrapping station and support them at the wrapping station during the wrapping operation.

4. A wrapping machine according to claim 1 wherein the lifting platform includes upwardly-extending support members for the articles, the support members being individually movable away from a supporting position on engagement by the wrapping blades which then serve to support the articles.

5. A wrapping machine according to claim 4 wherein the support members are biased by biasing means towards an upwardly-extending support position, the wrapping blades moving the members from such position to a non-supporting position against the action of the biasing means.

6. A wrapping machine according to claim 1 wherein the holding means includes clamping bars releasably clamping the film edges against a fixed abutment during the wrapping operation.

7. A wrapping machine according to claim 1 comprising a main drive motor common to the aricle feed means, the discharge means, and the wrapping means, whereby such means are operated in synchronism with one another, a further drive motor being provided for operating the film feed means.

8. A wrapping machine according to claim 1 wherein the discharge means includes a heated conveyor on which the wrapped articles are received from the wrapping station, the conveyor being arranged to heat the overlapped film on the underside of the article to seal and secure the film.

9. A wrapping machine according to claim 1 wherein each of the wrapping blades has a leading edge which engages the film during a wrapping operation and which is rectilinear and includes a roller rotatable about an axis at a right angle to the respective direction of movement of the blade.

10. A wrapping machine according to claim 1 wherein the holding means comprises clamps directly engaging three of the edges of the length of film during the initial part of the wrapping operation, the remaining edge of the length of film being attached through perforations to a roll of film.

* * * * *